US006863799B2

(12) United States Patent
Bushman

(10) Patent No.: US 6,863,799 B2
(45) Date of Patent: Mar. 8, 2005

(54) COMBINATION GALVANIC ANODE AND WEAR PLATE FOR STORAGE TANKS

(75) Inventor: James B. Bushman, 6395 Kennard Rd., Medina, OH (US) 44256

(73) Assignee: James B. Bushman, Medina, OH (US)

( * ) Notice: Subject to any disclaimer, the term of this patent is extended or adjusted under 35 U.S.C. 154(b) by 455 days.

(21) Appl. No.: 10/153,404

(22) Filed: May 22, 2002

(65) Prior Publication Data

US 2002/0185381 A1 Dec. 12, 2002

Related U.S. Application Data

(63) Continuation-in-part of application No. 09/858,063, filed on May 15, 2001.

(60) Provisional application No. 60/204,247, filed on May 15, 2000, and provisional application No. 60/218,955, filed on Jul. 17, 2000.

(51) Int. Cl.[7] ..... C23F 13/00

(52) U.S. Cl. ..... 205/740; 205/730; 205/732; 205/733; 29/825; 29/890.051; 29/745; 29/746; 204/196.18; 204/196.23; 204/196.24; 204/196.25; 204/196.3; 204/196.34; 204/196.37; 204/280; 204/286.1

(58) Field of Search ..... 205/730, 732, 205/733, 740; 29/825, 890.051, 745, 746; 204/196.18, 196.23, 196.24, 196.25, 196.3, 196.34, 196.37, 280, 286.1

(56) References Cited

U.S. PATENT DOCUMENTS

| | | | | | |
|---|---|---|---|---|---|
| 3,994,795 | A | * | 11/1976 | Kurr | 204/196.16 |
| 4,190,512 | A | * | 2/1980 | Wyatt et al. | 204/196.21 |
| 5,293,681 | A | * | 3/1994 | Tuma | 29/700 |
| 5,783,058 | A | * | 7/1998 | Fowler et al. | 205/205 |
| 6,331,242 | B1 | * | 12/2001 | Horton | 205/724 |
| 6,613,216 | B2 | * | 9/2003 | Bushman | 205/740 |

* cited by examiner

*Primary Examiner*—Bruce F. Bell
(74) *Attorney, Agent, or Firm*—Fay, Sharpe, Fagan, Minnich & McKee, LLP

(57) ABSTRACT

A method for manufacturing improved cast anodes for corrosion protection in storage tanks calls for integrating a plurality of spaced steel core rods into a sacrificial galvanic anode material sheet. The sheet is divided into segments such that a width of each segment is four to eight times the thickness of the galvanic sheet.

23 Claims, 4 Drawing Sheets

COMBINATION GALVANIC ANODE AND WEAR PLATE FOR STORAGE TANKS

This application is a continuation-in-part of U.S. Ser. No. 09/858,063 filed May 15, 2001 which claims priority from U.S. Provisional Application Ser. No. 60/204,247 filed May 15, 2000 and Ser. No. 60/218,955 filed Jul. 17, 2000.

BACKGROUND

Fuel and other types of liquid storage tanks are typically tested for product depth by placement of a calibrated length dip stick into the tank through one of the access ports defined in a tank wall. The contacting of the tank bottom during this product depth measurement process initiates and accelerates corrosion activity in the bottom of the storage tanks, particularly when and where moisture accumulates through condensation and other moisture introduction processes.

Both industry standards and state regulatory agencies require placement of steel wear plates directly under each access port to prevent this corrosion accelerating process on the bottom of each tank. However, corrosion has also been found adjacent to or under these corrosion wear plates due to the development of corrosion inducing microbacteria and other galvanic corrosion inducing processes. Corrosion also occurs elsewhere in the tank such as adjacent seams or at other points therein.

It is not uncommon for water to accumulate at the bottom of an underground storage tank. Although the water depth is somewhat minimal, often less then one inch, it promotes corrosion in the tank wall.

There is a need to further protect against mechanical damage and corrosion to fuel or other types of liquid storage tanks at the location of wear plates and elsewhere throughout the tanks. There is also a need to improve the corrosion resistance of wear plates themselves.

SUMMARY OF THE INVENTION

In accordance with the present invention, there is provided a novel wear plate with galvanic protection that reduces or eliminates mechanical damage and corrosion to the bottom, sides or walls of steel fuel storage tanks, other storage tanks, and to wear plates themselves. The improved wear plate reduces or eliminates the current style of steel wear plates.

The present invention is directed to the development of a combination galvanic anode and wear plate. The placement of galvanic anodes in the bottom of storage tanks can reduce or eliminate the corrosion process in the tanks. By combining the function of the steel wear plate, which also functions as the core strap for the anode casting, and a galvanic anode, a synergistic effect is achieved at a substantially reduced cost over two separately installed elements.

The present invention is still further directed to a novel anode design having a thin cross section. The novel thin anode is cast in thin cross section with multiple small steel cores situated such that the large multi-cored anode can be separated into small individual anodes having one, two or more steel core rods.

The present invention contemplates the use of any suitable galvanic anode material that will function in the storage tank environment. In the case of fuel storage tanks, the preferred galvanic anode material is zinc. Zinc is preferred because it is non sparking and, therefore, approved for use in confined spaces containing flammable substances.

The present invention further contemplates the use of integrated wear or striker plates and anodes for use anywhere inside liquid storage tanks in order to reduce or eliminate corrosion damage to the tanks.

An advantage of the present invention is that the life of the storage tanks will be increased due to a reduction in corrosion.

Another advantage of the present invention is the reduction in corrosion and mechanical damage to storage tanks which, in turn, reduces risk of leaks and exposure of the storage tank contents to the surrounding environment.

Another advantage is found in the increased life of the wear plate over conventional steel wear plates.

Another advantage of the present invention is found in the relative thinness of the individual anodes. The thin cross section enables full submersion on of the anode into shallow water accumulation levels in the bottom of tanks. Complete submersion enables delivery of corrosion control current from the entire top and side surfaces of the anode, thus extending the energy output of the anode at least two to three fold over a typical anode which is not fully submergible. The typical anode, much thicker in cross section, generally does not completely submerge in shallow water (on the order of less than 1 inch deep) so the anode operates much less efficiently since the top and a portion of the sides are not submerged. The typical anode of the prior art, with its top and sides exposed, generally delivers corrosion control only a limited distance laterally from those limited side surfaces of the anode which are submerged. The bottom of the anode can only deliver protection to the tank bottom it is in contact with.

Another advantage is found in the manufacturing method. The method of manufacture of the anode of the present invention enables the thin cross section to be realized.

Another advantage of the anode is the single casting of a multiple core anode which is intentionally cast in a configuration where it may be mechanically separated in to smaller individual anodes which can then be placed at selected locations within the tank. The width of the separate anode can vary by having a minimum of one steel core, two cores or more.

Yet another advantage of the present invention is found in the cost savings achieved in developing a single combined anode and wear plate unit over the separate installation of the two elements.

Still other advantages and benefits of the invention will become apparent to those skilled in the art upon reading and understanding of the following detailed description.

BRIEF DESCRIPTION OF THE DRAWINGS

The invention may take physical form in certain parts and arrangements of parts, a preferred embodiment which will be described in detail in the specification and illustrated in the accompanying drawings which form a part hereof.

DESCRIPTION OF THE PREFERRED EMBODIMENT

Figure 1:
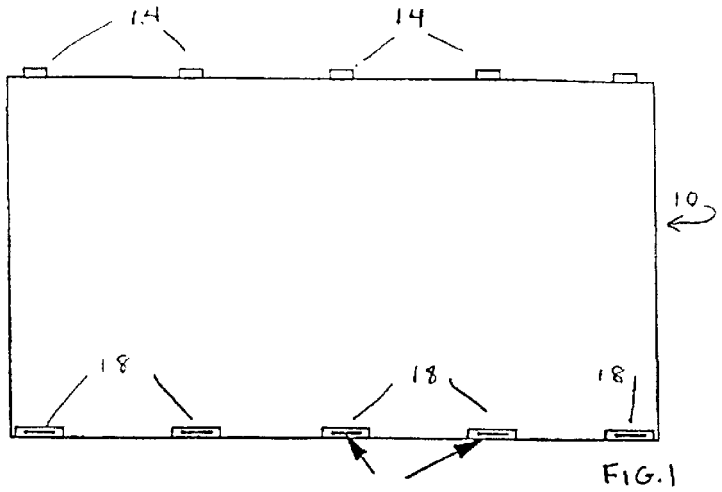
FIG. 1 is schematic representation of a side view of a fuel storage tank.

Referring now to the drawings wherein the showings are for purposes of illustrating the preferred embodiment of the invention only and not for purposes of limiting same, the figures show a steel wear plate and galvanic anode combination situated in a fuel tank environment.

FIG. 1 is a side view of a fuel storage tank 10. A plurality of access ports 14 are shown across the top of the tank. Combination or integrated galvanic anodes and wear plates 18 are shown directly opposite or under each access port. This is simply a typical arrangement of the anode/striker plate placement within the tank. The integrated striker plate and anode could likewise be placed anywhere inside the tank, such as for example at a lapped seam, or anywhere that corrosion protection is desired or needed. The placement of galvanic anodes in the bottom of storage tanks can reduce or eliminate the corrosion process.

The present invention contemplates the use of any suitable galvanic anode material that will function in the storage tank environment.

Figure 2:
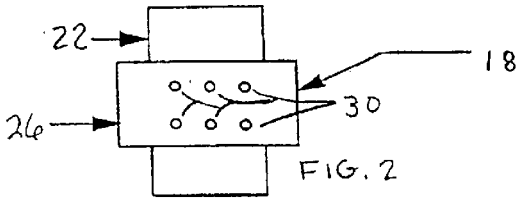
FIG. 2 schematically depicts a combination galvanic anode and wear plate.
Figure 3:
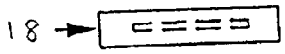
FIG. 3 shows a side view of the combination galvanic anode and wear plate of FIG. 2.

FIGS. 2 and 3 depict a combination galvanic anode and wear plate 18. The combination comprises a steel wear plate portion 22, and a galvanic anode portion 26 integrated with or affixed to the steel wear plate. Although any suitable galvanic anode material can be used, zinc is preferred because it is non sparking and therefore approved for use in confined spaces containing flammable substances such as fuel and other substances. Alternative galvanic anode materials include magnesium and aluminum and others. Zinc, magnesium and aluminum are preferred anode materials for use in steel tanks. The anode can be cast around or on the galvanized steel wear plate, or the anode could be otherwise fastened or adhered to the plate. A plurality of perforations 30 are defined by the anode in the Figures. These apply to the cast example. In the case of anodes fastened by studs or adhered by other means, the perforations may not be present.

The anode can be larger or smaller than the wear plate. It can be cast around the plate, or the plate can be layered on the anode. The plate can be exposed or not exposed by the anode. In a preferred embodiment, as discussed below, the steel plate is replaced by a steel core rod. In such a situation, the anodic material itself becomes the striker or wear plate.

Figure 4:
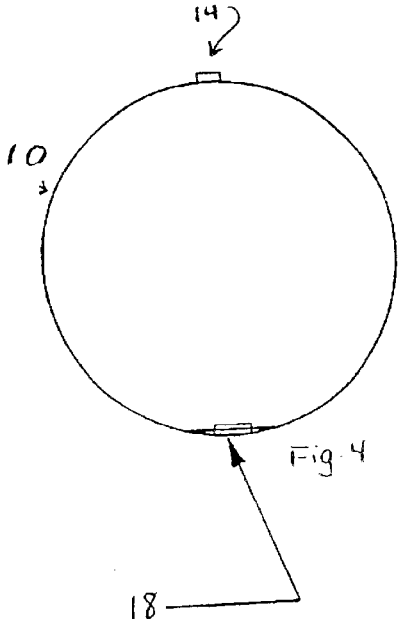
FIG. 4 is an end view of a storage tank with a combination galvanic anode and wear plate situated opposite an access port.

FIG. 4 is an end view of the tank with the anode and wear plate combination 18 welded in place under an access port. The combination can be welded directly under each tank access port by the tank fabricator, or at ends or seams of the tank or anywhere in the tank where corrosion is foreseeable. The tanks can be designed to hold any type of liquid, including fuel water, chemicals, petroleum based products, and so on. The water or condensation serves as the electrolyte for the corrosion reduction process to occur.

Figure 5A:
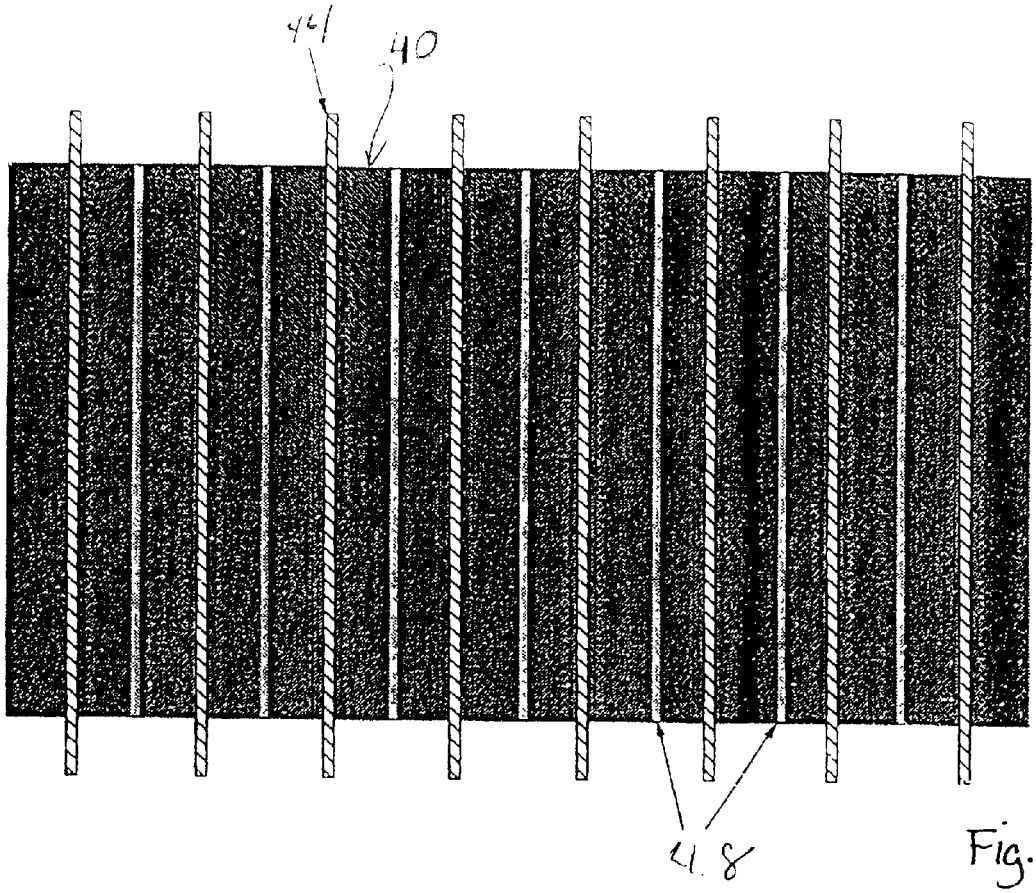
FIGS. 5A and 5B provide a schematic representation of an integral cast striker plate and anode.
Figure 5B:
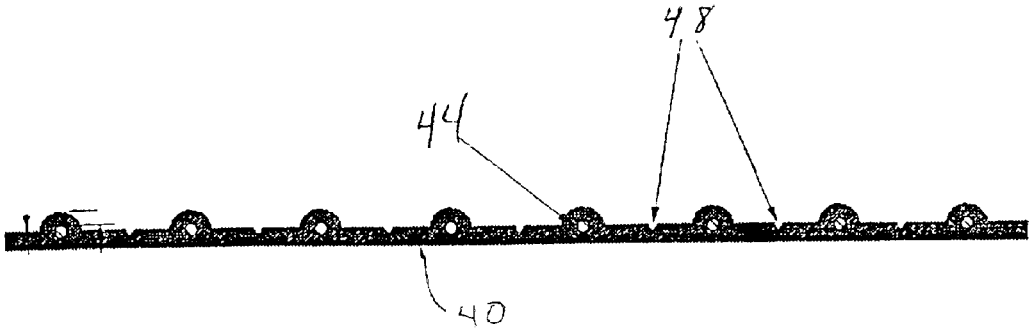

The striker unit of FIGS. 5A and 5B is integrally cast as one large plate, which provides for a less expensive production cost over separate castings. The galvanic material makes up the striker portion of the plate 40. A galvanized steel core rod 44 is provided within the plate. The plate can be split apart to create any width anode as long as it preferably includes at least one galvanized steel core wire (rod or strap) 44. Preferably, the plate includes a seam or detent 48 which makes it easier to separate the sheet into different pieces, although its presence is not absolutely necessary. The plurality of seams or detents shown in FIGS. 5A and 5B also make it easier to bend the anode to conform to cylindrically curved surface of the tank bottom.

The galvanic wear plate of the present invention can distribute a current up to five to ten feet away. As a result, it is possible that only four or five plates are required for a ten-thousand gallon tank.

A typical size of striker plate anode might be in a range of 8"×8" to 8"×12" to 12"×12", or larger or smaller. Additional smaller sizes could be used in between striker plate locations for protection on the bottom centerline of a tank or over lapped seams on the bottom of a tank. For example, the size in this case might be 3"×12", or greater or smaller. The rod space could be changed when cast to allow 2" wide strips or whatever spacing might be deemed suitable.

Figure 6A:
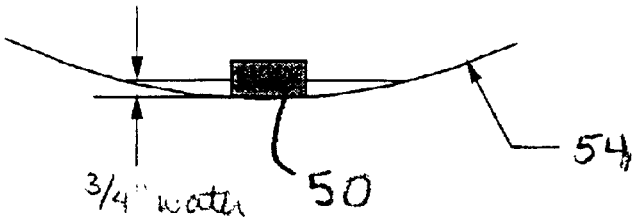
FIGS. 6A and 6B show a comparison between the prior art thick anode single casting and the thin anode single segment when cut from the large plate anode design of the present invention.
Figure 6B:
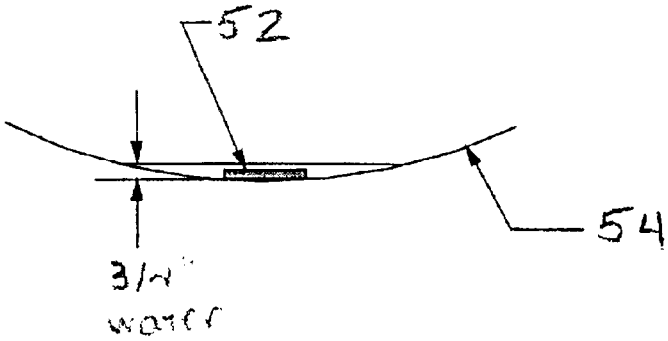

FIGS. 6A and 6B compare the prior art of a thin single cast anode design 50 (FIG. 6A) with the thin anode design of the present invention (FIG. 6B) which was first cast as part of a multiple core anode plate which was then mechanically separated into a smaller anode of a size more desirable for use in a particular location within the tank. As shown in FIG. 6B, when the prior art anode is placed in a tank 54 holding about ¾" of water accumulation, an upper portion 58 of the anode is exposed. Since only the immersed sides of the anode are able to deliver effective corrosion control laterally from the anode, the prior art anode of FIG. 6A is inefficient. The bottom of the anode can only deliver core protection directly to the tank bottom it is in contact with.

When the thin long anode 52 of FIG. 6B is placed in the same ¾" water depth, the anode is thin enough to be completely submerged. The improved anode of FIG. 6B can deliver current laterally to the submerged tank surfaces from all of its sides surface and its entire top. Since the exposed useful surface is greater then that of the prior art, the protective current output of novel design can be more then two to three times that of the typical anode. This remains the case until, in the case of a ¼" thick anode, the water level falls below ⅜ inch.

EXAMPLE

Figure 7A:
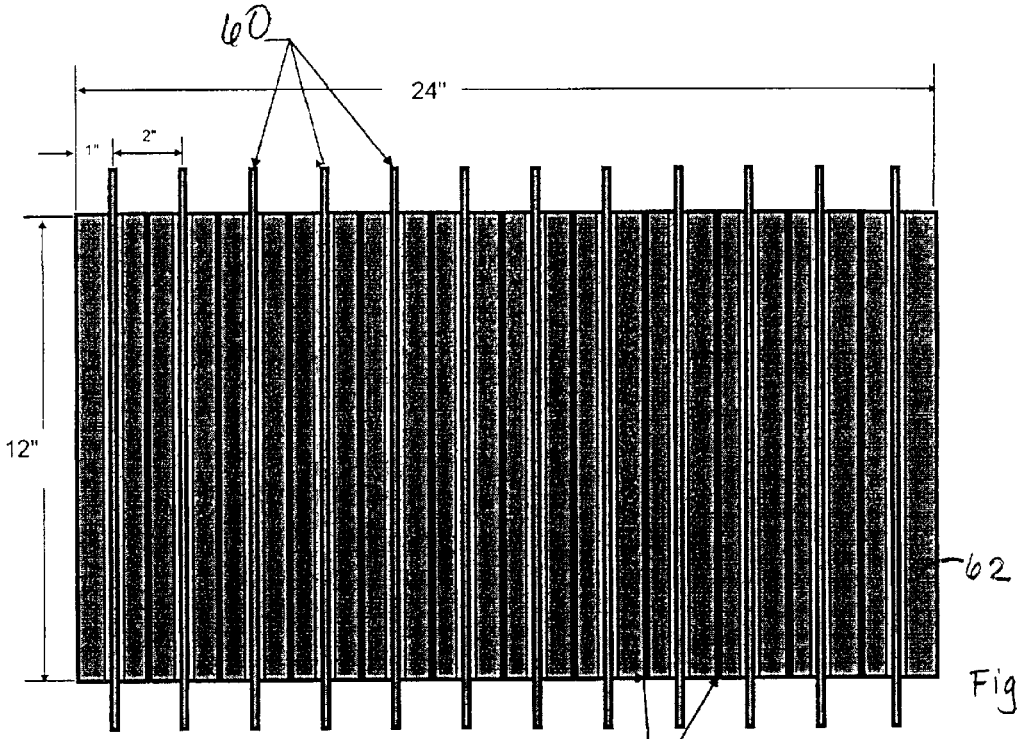
FIGS. 7A and 7B set forth schematic representations of the anode/striker plate of the present invention.
Figure 7B:
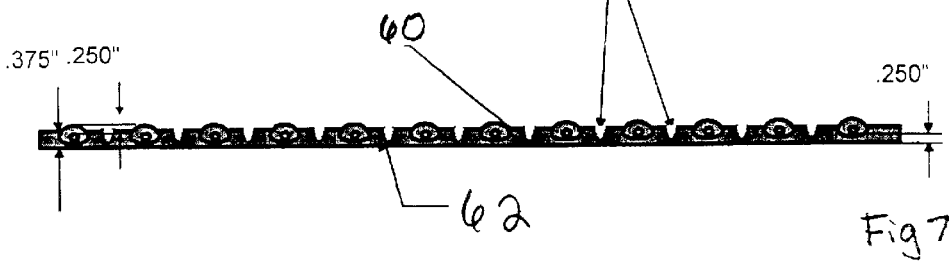

FIGS. 7A and 7B set forth a preferred embodiment anode. Twelve electro-galvanized steel core rods 60 of roughly one eighth inches in diameter and fifteen inches in length are spaced approximately 2 inches apart. The zinc anode grade cast ingot 62 is molded around this plurality of steel core rods. As shown in FIG. 7B, the thickness of the anode is generally 0.375", with about a 0.250" anodic layer around each steel core rod. A plurality of ¼" detents 64 are shown to enable blending or breaking the cast ingot into small, thin anode segments. The detents are not required, however, the plurality of thin long anodes can be cut, broken, sheared or otherwise separated into small individual anodes such as shown in FIG. 6B. As shown in the figure, the zinc portion of the anode is preferably twelve inches long and about 2 inches wide. In the alternative, they can be cut to include multiple cores so that an anode comprises more than a single segment. For example, a two segment anode would be about four inches side.

A unique feature of the long thin anodes derived from the methodology of the subject invention is the resulting anode's thin cross section shape. The large anode casting, such as shown in FIG. 7A, is cast with multiple small steel cores so that it can later be divided into individual anodes.

The resulting thin individual anode segments derived from the large unit range from a thickness of about ⅛" to ¼" or ½", while the width of a single core anode is at least four times the thickness, though more typically eight times the thickness. The length is typically 2 to 12 times the width. The unusual anode dimensions make it ideally suited for immersion longitudinally along the center line in the bottom of an underground storage tank where accumulated water is often only ½" to 1" deep.

The invention has been described with reference to the preferred embodiment. Obviously modifications and alterations will occur to others upon a reading and understanding of this specification. It is intended to included all such modifications and alterations.

Having thus described the preferred embodiment, the invention is now claimed to be:

1. A method of manufacturing improved cast anodes for corrosion protection in storage tanks, comprising the steps of:

integrating a plurality of spaced steel core rods within a sheet of cast galvanic anode material;

dividing the galvanic anode material into segments such that a width of each segment is at least four times as great as a thickness of the galvanic anode material.

2. The method of claim 1 including the additional step of:

incorporating a plurality of spaced detents within the cast sheet for ease of separating the sheet into multiple segments.

3. The method of claim 1 including the step of:

forming each segment to be about 4 to 8 times wider than thick.

4. The method of claim 1 including the step of:

forming each segment to have a length that is at least 6 times the width.

5. The method of claim 4 including the step of:

forming each segment to have a length that is about 2–18 times the width.

6. The method of claim 1 wherein the thickness of the cast anode segment is less than about 1 inch.

7. The method of claim 6 therein the thickness of the cast anode is about ⅛ inch to less than about 1 inch.

8. The method of claim 7 wherein the thickness of the cast anode is about ⅛ inch to about 0.375 inch.

9. The method of claim 1 wherein the segments include at least one steel core rod therein.

10. The method of claim 1 wherein the segments include multiple steel core rods therein.

11. An improved anode for storage tanks, comprising:

a sacrificial cast galvanic anode having a width that is approximately at least four times its thickness;

a galvanized steel core rod in contact therewith.

12. The anode of claim 11 wherein the galvanic anode is comprised of zinc.

13. The anode of claim 11 wherein the galvanic anode is comprised of magnesium.

14. The anode of claim 11 wherein the galvanic anode is comprised of aluminum.

15. The anode of claim 11 wherein the thickness of the galvanic anode is approximately ⅛ inch to less than 1 inch.

16. The anode of claim 15 wherein the thickness of the galvanic anode is approximately ⅛ inch to about 0.375 inch.

17. The anode of claim 11 wherein a length of each anode is about 2–18 times the thickness.

18. The anode of claim 11 wherein the width of each anode is about 4–8 times the thickness.

19. A method of reducing corrosion in a storage tank, comprising the steps of:

integrating a plurality of spaced steel cores within a galvanic anode material;

dividing the galvanic anode material into segments such that a width of each segment is at least four times as great as a thickness of the galvanic anode material;

placing at least one segment of the integrated steel core and galvanic anode in a tank in a position prone to corrosion;

reducing the incidence of corrosion within said tank.

20. The method of claim 19 wherein the at least one segment of integrated steel core and galvanic anode is submerged in accumulated water within a storage tank.

21. The method of claim 19 including the additional step:

sacrificing the anode material to prevent corrosion in the tank.

22. The method of claim 20 wherein substantially all surfaces of the anode material direct corrosion control.

23. The method of claim 19 including the additional stop of dividing the galvanic anode material into segments wherein each segment is about 4 to 8 times wider than it is thick, and 6 to 18 times longer than the width.

* * * * *